United States Patent [19]

Jinno

[11] Patent Number: 5,061,210

[45] Date of Patent: Oct. 29, 1991

[54] CONNECTOR WITH TERMINAL RETAINER

[75] Inventor: Keishi Jinno, Shizuoka, Japan

[73] Assignee: Yazaki Corporation, Tokyo, Japan

[21] Appl. No.: 567,566

[22] Filed: Aug. 16, 1990

[30] Foreign Application Priority Data

Aug. 24, 1989 [JP] Japan ..... 1-215998

[51] Int. Cl.[5] ..... H01R 13/514

[52] U.S. Cl. ..... 439/752; 439/595

[58] Field of Search ..... 439/592, 594, 595, 733, 439/752

[56] References Cited

U.S. PATENT DOCUMENTS 4,867,705 9/1989 Yuasa ..... 439/595
4,950,182 8/1990 Zielinski et al. ..... 439/595
4,973,268 11/1990 Smith et al. ..... 439/595

FOREIGN PATENT DOCUMENTS 2230391 10/1990 United Kingdom .

*Primary Examiner*—Eugene F. Desmond
*Attorney, Agent, or Firm*—Sughrue, Mion, Zinn, Macpeak & Seas

[57] ABSTRACT

Two-step attachment of a terminal retainer into a connector housing is achieved, without requiring a substantial increase in the size of the housing, by providing an erroneous insertion-preventing portion on the terminal retainer. This portion is disposed in opposed relation to a respective portion of a connector housing in a first insertion step. By pressing a manipulation piece on the terminal retainer, the erroneous insertion-preventing portion is moved out of the opposed relation, enabling completion of the second insertion step.

4 Claims, 4 Drawing Sheets

CONNECTOR WITH TERMINAL RETAINER

BACKGROUND OF THE INVENTION

The present invention relates to a connector, used to connect wire harnesses or the like, having a terminal retainer connected to a connector housing so as to prevent rearward withdrawal of metal terminals inserted in respective terminal receiving chambers of the connector housing.

In retaining a metal terminal which is inserted in a terminal receiving chamber of a connector housing, it is a common practice to form a flexible retaining arm integrally on an inner surface of the terminal receiving chamber, so that the flexible retaining arm can engage the metal terminal inserted in the terminal receiving chamber, thereby preventing rearward withdrawal of the metal terminal. Recently, a construction has been proposed in which a terminal retainer is connected to a rear portion of a connector housing, so that the terminal retainer, either alone or in combination with the above-mentioned flexible retaining arm, can positively prevent rearward withdrawal of the metal terminal.

FIG. 5A shows such a conventional retaining construction, wherein a retaining piece c is provided integrally at each terminal receiving chamber b of a connector housing made of a synthetic resin, and projections e and f for engaging a terminal retainer member d are provided respectively on upper and lower walls of the connector housing.

The terminal retainer member d has a frame g and upper and lower flexible lock arms h and i. The flexible lock arm h has a provisionally-retaining portion $h_2$ and a completely-retaining portion $h_3$ which are interconnected by an abutment step portion $h_1$. Terminal portions l for engagement respectively with electric wire-clamping portions $k_1$ of metal terminals k (FIG. 5B) are provided at a front portion of the frame g having terminal insertion holes j.

In the above construction, the connector housing a and the terminal retainer member d are connected provisionally in a condition shown in FIG. 5B. Each metal terminal k is inserted into the terminal receiving chamber b through the terminal insertion hole j of the frame g to be engaged with the retaining piece c. In this condition, since the abutment step portion $h_1$ of the flexible lock arm h is abutted against a rear end $a_1$ of the upper wall of the connector housing a, the terminal retainer member d is prevented from advancing further, and hence will not be moved accidentally to a completely-connected position.

Then, the terminal retainer member d is moved upward in a direction intersecting the advancing direction, so that the abutment step portion $h_1$ is displaced upwardly from the rear end $a_1$ of the upper wall of the connector housing a, as shown in FIG. 5C. In this condition, the terminal retainer member d is advanced again, so that the completely-retaining portion $h_3$ of the flexible lock arm h is engaged with the projection e, with the flexible lock arm i engaged with the projection f, thus shifting the terminal retainer member into the completely-connected condition shown in FIG. 5D.

In the foregoing conventional structure, when the terminal retainer member d is to be shifted from the provisionally-connected condition to the completely-connected condition with respect to the connector housing a, the terminal retainer member is required to advance in the same direction as the direction of insertion of the metal terminal, and also to move in a direction intersecting this direction. This multiple-direction movement results in a required increase in the external size of the terminal retainer member d.

The present invention has been made in view of the foregoing, and seeks to provide a construction in which a terminal retainer member will not be moved accidentally from a provisionally-connected condition to a completely-connected condition with respect to a connector housing, without increasing the size of the terminal retainer member.

SUMMARY OF THE INVENTION

The above object has been achieved by a connector with a terminal retainer, which includes a connector housing having terminal receiving chambers, metal terminals inserted respectively into the terminal receiving chambers, and a terminal retainer connectable in two steps to a rear portion of the connector housing. The terminal retainer includes an erroneous insertion-preventing flexible piece which has an abutment portion disposed in opposed relation to an erroneous insertion-preventing portion of the connector housing in a provisionally-connected condition (one of the two steps), and a manipulating portion.

When the terminal retainer is provisionally connected to the connector housing, the erroneous insertion-preventing flexible piece is displaced through the manipulating portion to displace the abutment portion out of facing relation to the erroneous insertion-preventing portion of the connector housing, thereby shifting the terminal retainer into the completely-connected condition (the second of the two steps).

DETAILED DESCRIPTION OF THE PREFERRED EMBODIMENT

Figure 1:
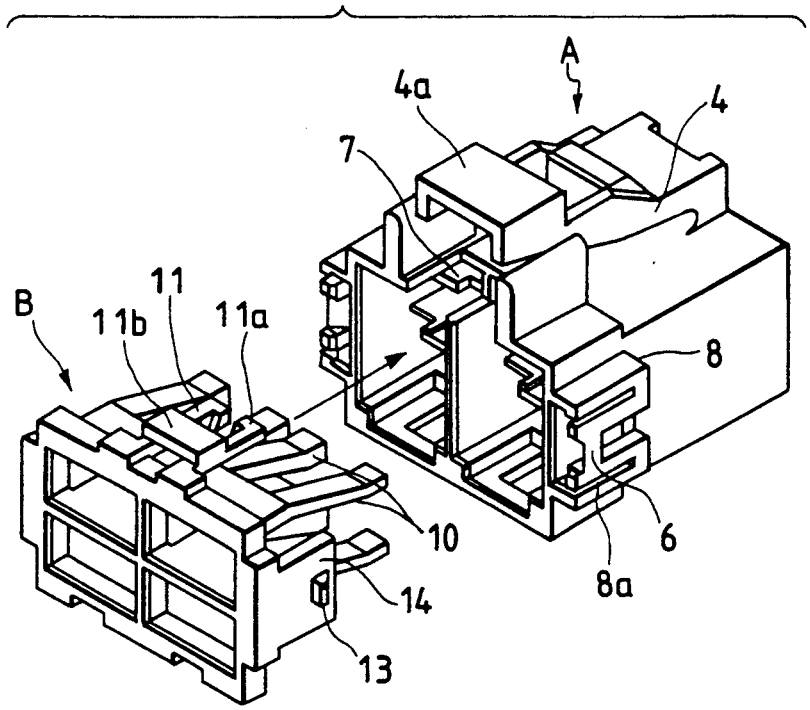
FIG. 1 is a perspective view of a preferred embodiment of the present invention in its separated condition.

In FIG. 1, reference character A denotes a connector housing made of a synthetic resin, and reference character B denotes a terminal retainer made of a synthetic resin, and connectable to a rear portion of the connector housing. The connector housing A is adapted to be fitted relative to a mating connector housing (not shown).

Figure 3A:
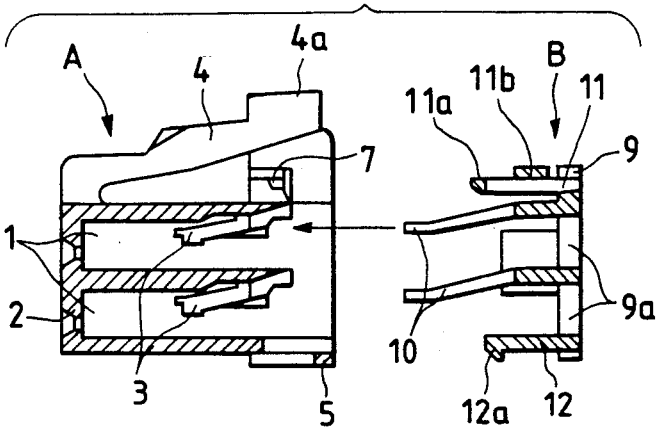
FIGS. 3A to 3F are cross-sectional views showing the steps of connecting a terminal retainer to a connector housing.

As seen in FIG. 3A, the connector housing A has upper and lower rows of juxtaposed terminal receiving chambers 1. A stopper 2 is provided at a front end of each terminal receiving chamber 1. A flexible retaining arm 3 is formed integrally on an inner surface of each terminal receiving chamber 1 at an intermediate portion thereof. A flexible lock arm 4 is provided for the mating female connector housing.

A provisionally-connecting portion 5 for the terminal retainer B is provided on a bottom surface of the connector housing A. Completely-connecting portions 6 are provided respectively at the right and left sides of the connector housing. An erroneous insertion-preventing portion 7 is provided below a manipulating portion 4*a* of the flexible lock arm 4, and is directed rearwardly. The completely-connecting portion 6 is formed by providing slits 8*a* (FIG. 1) in a support frame 8 which is open at its rear end and extends in a forward-rearward direction.

Figure 2:
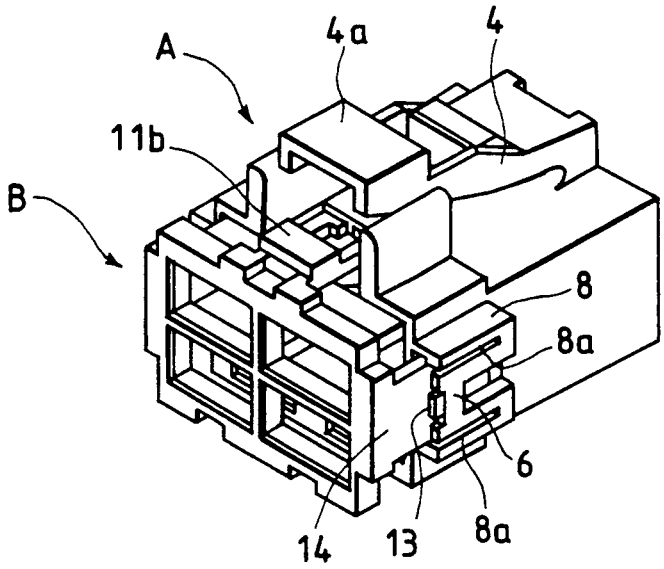
FIG. 2 is a perspective view of the embodiment in its provisionally-connected condition.

Referring again to FIG. 3A, the terminal retainer B includes a frame-like main portion 9 having insertion portions 9*a* therein for respectively receiving metal terminals C as well as electric wires D connected thereto, and a plurality of projecting flexible retaining pieces 10 extending from the front end of the main portion 9 and corresponding respectively to the upper and lower rows of terminal receiving chambers 1. The terminal retainer B further has, at its upper side, an erroneous insertion-preventing flexible piece 11 having an abutment projection 11*a*, and has at its lower side a flexible piece 12 having a provisionally-connecting projection 12*a*. Also, the terminal retainer has, at its right and left sides, plate-like support pieces 14, each having a completely-connecting projection 13 (FIGS. 1 and 2).

In the above construction, the connector housing A and the terminal retainer B in their separated condition as shown in FIGS. 1 and 3A are provisionally connected together by inserting the plate-like support pieces 14 respectively into the support frames 8, and by engaging the provisionally-connecting projection 12*a* of the flexible piece 12 with the provisionally-connecting portion 5. In this condition, since the abutment projection 11*a* of the erroneous insertion-preventing flexible piece 11 is opposed to the erroneous insertion-preventing portion 7, further advance of the terminal retainer B is prevented (FIGS. 2 and 3B).

There is play, or a gap, between the plate-like support piece 14 and the support frame 8 in an upward-downward direction, so that the terminal retainer B in the provisionally-connected condition can be inclined in the upward-downward direction relative to the connector housing A. When the metal terminal C is inserted into the terminal receiving chamber 1 through the insertion portion 9*a*, the metal terminal C is brought into contact with the flexible retaining piece 10, so that all or part of the terminal retainer B is inclined and displaced out of a path of movement of the metal terminal, thereby enabling an easy insertion of the metal terminal C (FIG. 3C). The inserted metal terminal C is retained by the flexible retaining arm 3.

Figure 3D:
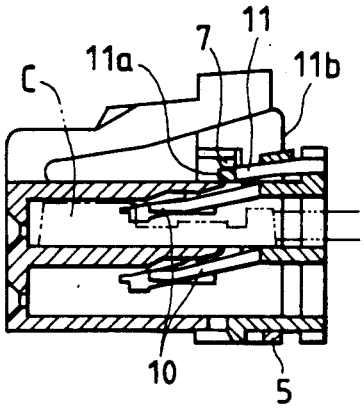
Figure 3B:
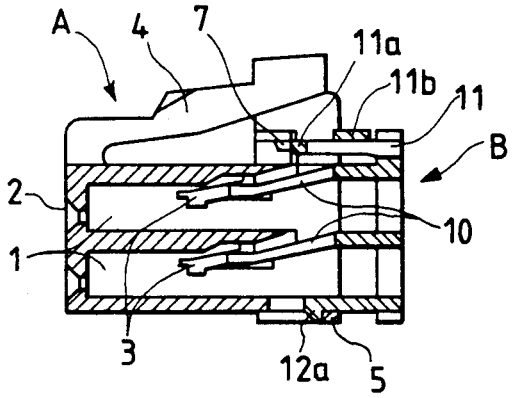
Figure 3E:
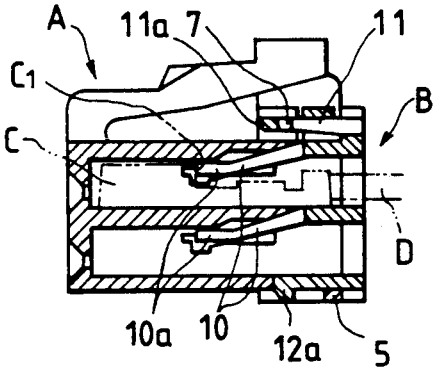
Figure 3C:
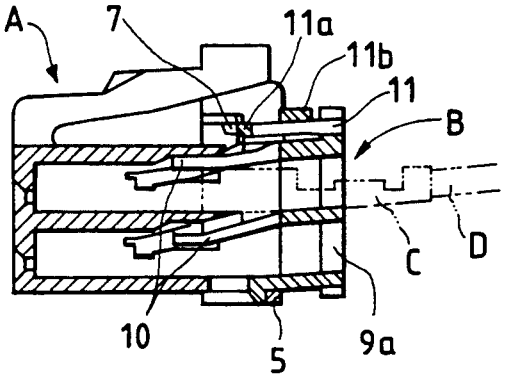
Figure 4A:
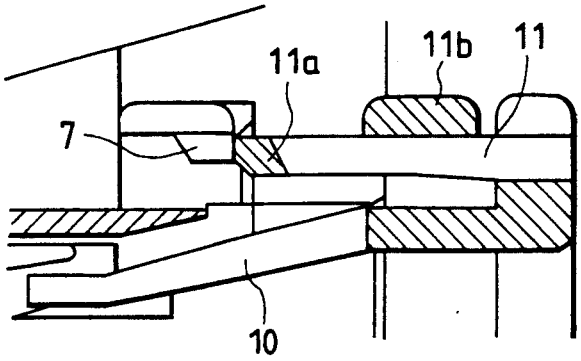
FIGS. 4A to 4C are enlarged cross-sectional views showing the steps of connecting the terminal retainer to the connector housing.
Figure 4B:
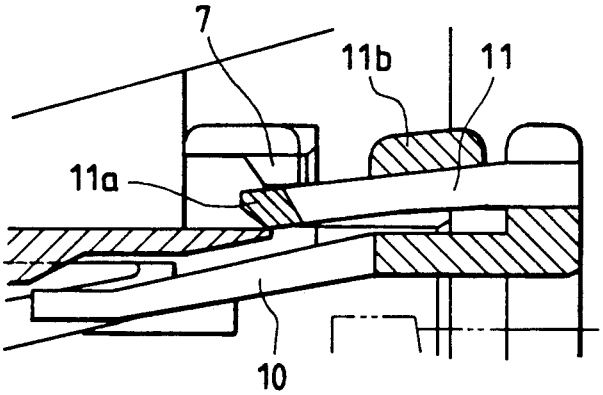
Figure 4C:
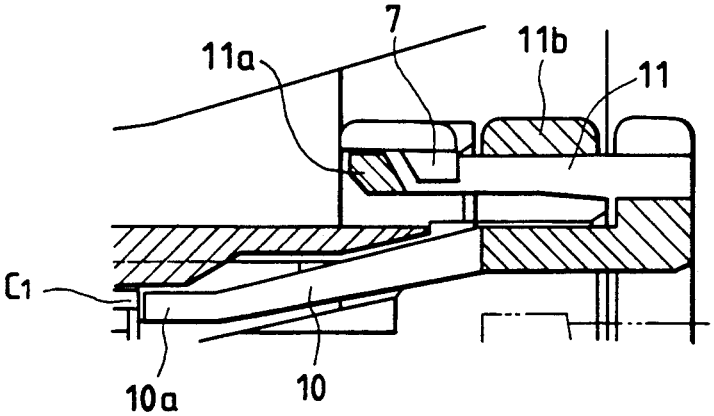
Figure 5A:
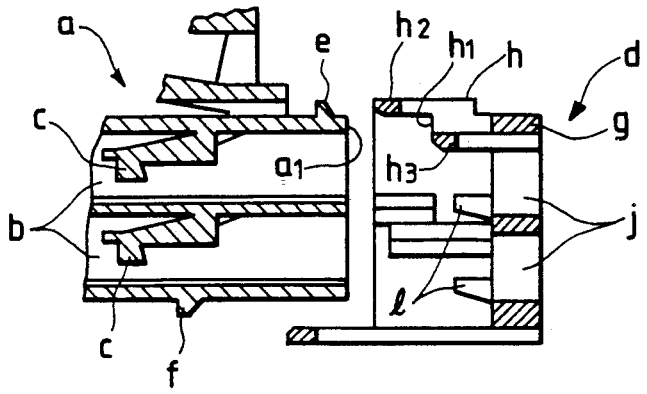
FIGS. 5A to 5D are cross-sectional views showing the steps of connecting a terminal retainer to a connector housing conventionally.
Figure 5C:
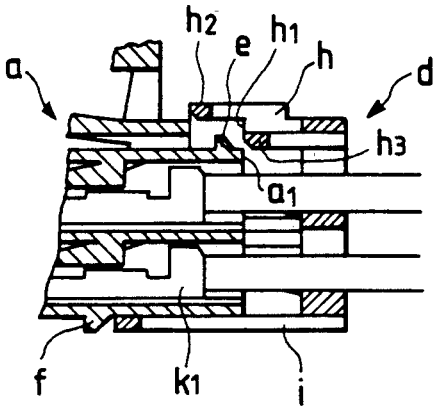
Figure 5B:
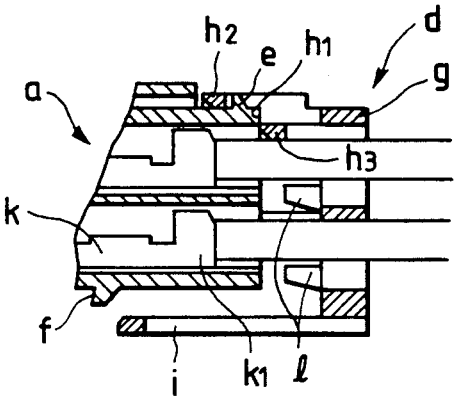
Figure 5D:
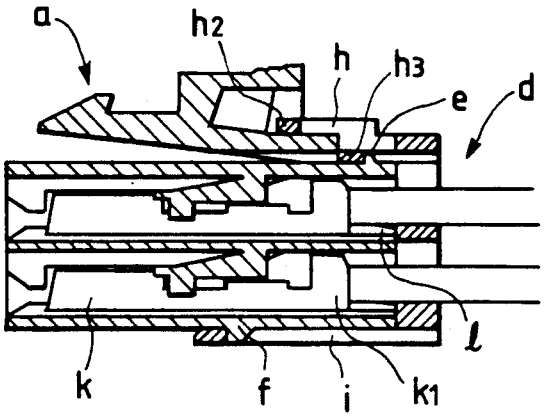

Then, the erroneous insertion-preventing flexible piece 11 is depressed through a manipulating portion 11*b* to bring its abutment projection 11*a* out of facing relation to the erroneous insertion-preventing portion 7 (FIGS. 3D, 4A, and 4B). In this condition, the terminal retainer B is pushed to engage the completely-connecting projections 13 with the completely-connecting portions 6, respectively. As a result, the flexible retaining piece 10 is disposed at a rear portion of a female electric contact portion $C_1$ of the metal terminal C to prevent rearward withdrawal of the metal terminal (FIGS. 3E and 4C). Thus, this provides double withdrawal prevention, together with the flexible retaining arm 3 of the connector housing A.

Figure 3F:
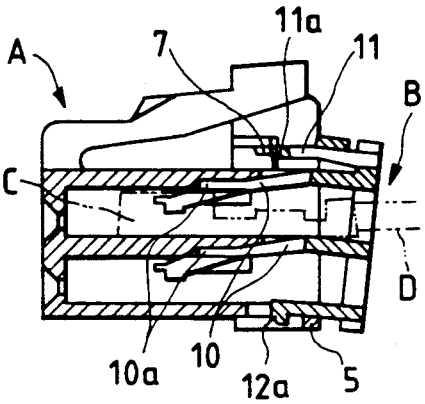

When it is necessary to withdraw the metal terminal C from the connector housing A, the right and left locks on the terminal retainer B are released, and then the terminal retainer is returned to the above provisionally-connected position so as to be inclined, so that an engaging end 10*a* of the flexible retaining piece 10 is displaced out of the path of movement of the metal terminal C (FIG. 3F). The metal terminal is withdrawn by releasing the engagement of the flexible retaining arm 3, using a jig.

With the above construction of the present invention, the terminal retainer can be shifted from the provisionally-connected condition to the completely-connected condition merely by manipulating the erroneous insertion-preventing flexible piece, without moving the entire terminal retainer relative to the connector housing in a direction intersecting the direction of insertion of the terminal retainer. Therefore, without particularly increasing the overall size of the terminal retainer, erroneous insertion of the terminal retainer can be prevented with a simple construction. Since, in the provisionally-connected condition, the terminal retainer is inclined relative to the connector housing to displace the retaining piece out of the path of movement of the metal terminal, the withdrawal of the metal terminal can be effected easily.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. A connector with a terminal retainer, comprising:

a connector housing having a plurality of terminal receiving chambers;

a plurality of metal terminals inserted into respective ones of said terminal receiving chambers; and a terminal retainer, connectable to a rear portion of said connector housing in two steps, constituting a provisionally-connected condition and a completely-connected condition, respectively;

said connector housing having an erroneous insertion-preventing portion, said terminal retainer including an erroneous insertion-preventing flexible piece which has an abutment portion disposed in opposed relation to said erroneous insertion-preventing portion of said connector housing in the provisionally-connected condition, and a manipulating portion for displacing said erroneous insertion-preventing flexible piece to displace said abutment portion and shift said terminal retainer into said completely-connected condition.

2. A connector with a terminal retainer according to claim 1, wherein, in said provisionally-connected condition, said terminal retainer is supported on said connector housing such that said terminal retainer can be inclined relative to said connector housing, said terminal retainer including a retaining piece for said metal terminal, said retaining piece being displaced out of a path of movement of said metal terminal when said terminal retainer is inclined.

3. A connector with a terminal retainer according to claim 1, wherein said terminal retainer includes a plurality of retaining pieces each extending from said terminal retainer to abut against a rear portion of respective one of said metal terminals in said completely-connected condition, thereby preventing rearward withdrawal of said metal terminals.

4. A connector with a terminal retainer according to claim 1, wherein said erroneous insertion-preventing flexible piece extends from said terminal retainer, and said abutment portion is provided at a distal end of said erroneous insertion-preventing flexible piece.

* * * * *